United States Patent [19]

Cullen et al.

[11] Patent Number: 4,911,739

[45] Date of Patent: Mar. 27, 1990

[54] SELF-RETAINING ADSORBENT CARTRIDGE FOR REFRIGERANT RECEIVER

[75] Inventors: John S. Cullen, Buffalo; Samuel A. Incorvia, Tonawanda, both of N.Y.

[73] Assignee: Multiform Desiccants, Inc., Buffalo, N.Y.

[21] Appl. No.: 376,431

[22] Filed: Jul. 7, 1989

[51] Int. Cl.[4] ..... B01D 53/04

[52] U.S. Cl. ..... 55/387; 55/389; 62/503; 210/282

[58] Field of Search ..... 55/179, 387, 388, 389; 62/503; 210/282

[56] References Cited

U.S. PATENT DOCUMENTS

| | | | |
|---|---|---|---|
| 4,111,005 | 9/1978 | Livesay | 62/503 |
| 4,116,649 | 9/1978 | Cullen et al. | 55/387 |
| 4,187,695 | 2/1980 | Schumacher | 62/503 |
| 4,199,960 | 4/1980 | Adams | 62/503 |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,401,447 | 8/1983 | Huber | 55/387 |
| 4,405,347 | 9/1983 | Cullen et al. | 55/387 |
| 4,457,843 | 7/1984 | Cullen et al. | 210/282 |
| 4,464,261 | 7/1984 | Cullen et al. | 210/282 |
| 4,474,035 | 10/1984 | Amin et al. | 62/503 |
| 4,496,378 | 1/1985 | Kish | 55/316 |
| 4,619,673 | 10/1986 | Cullen et al. | 55/387 |

*Primary Examiner*—Charles Hart

*Attorney, Agent, or Firm*—Joseph P. Gastel

[57] ABSTRACT

A self-retaining adsorbent cartridge having spaced adsorbent containers attached to each other at their inner ends by a yoke and having tab-like latch structure on their outer ends, the latch structure consisting of a flexible resilient latch member formed at the outer end of one of the adsorbent containers and a second latch member having an aperture therein for receiving the first latch member in locking engagement so that the spaced adsorbent containers will be secured in side-by-side relationship with a bend in the yoke. A self-retaining adsorbent cartridge having tab-like latch structure extending outwardly from opposite edges thereof for encircling conduits in a refrigerant receiver and binding the adsorbent cartridge thereto.

28 Claims, 3 Drawing Sheets

Fig. 8.
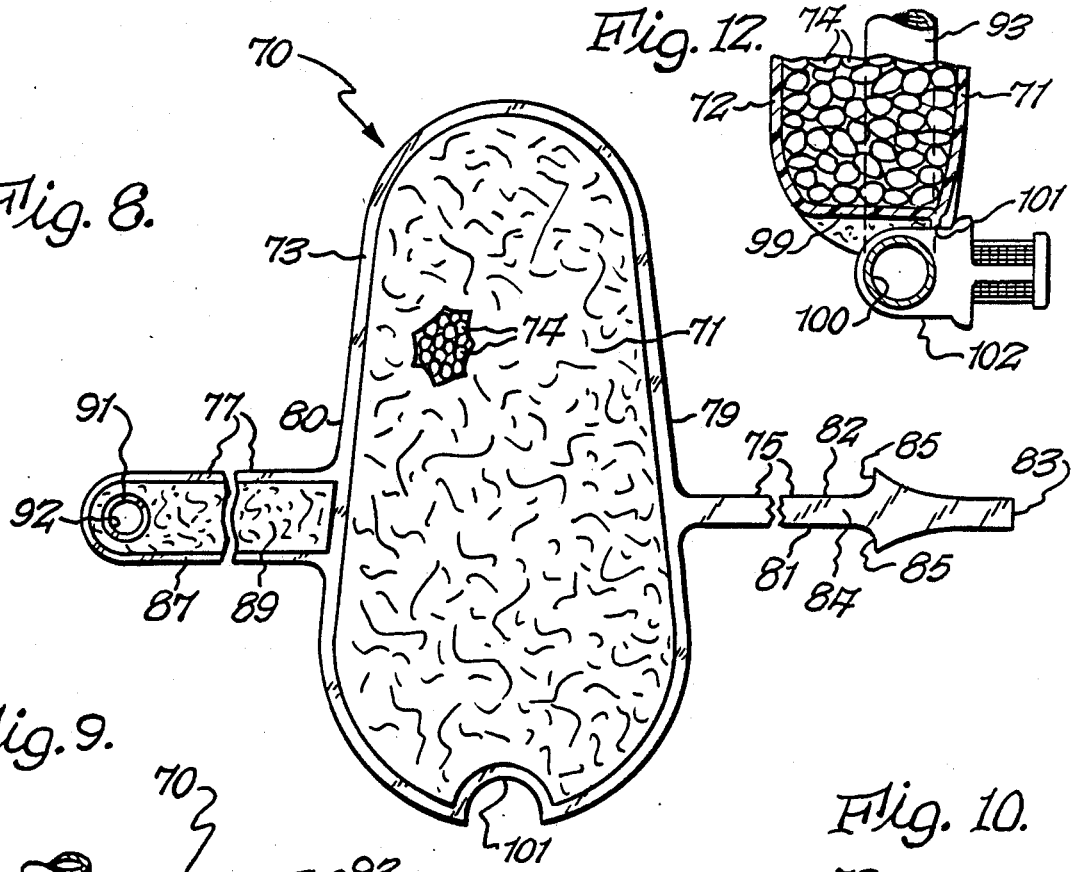
Fig. 12.
Fig. 9.
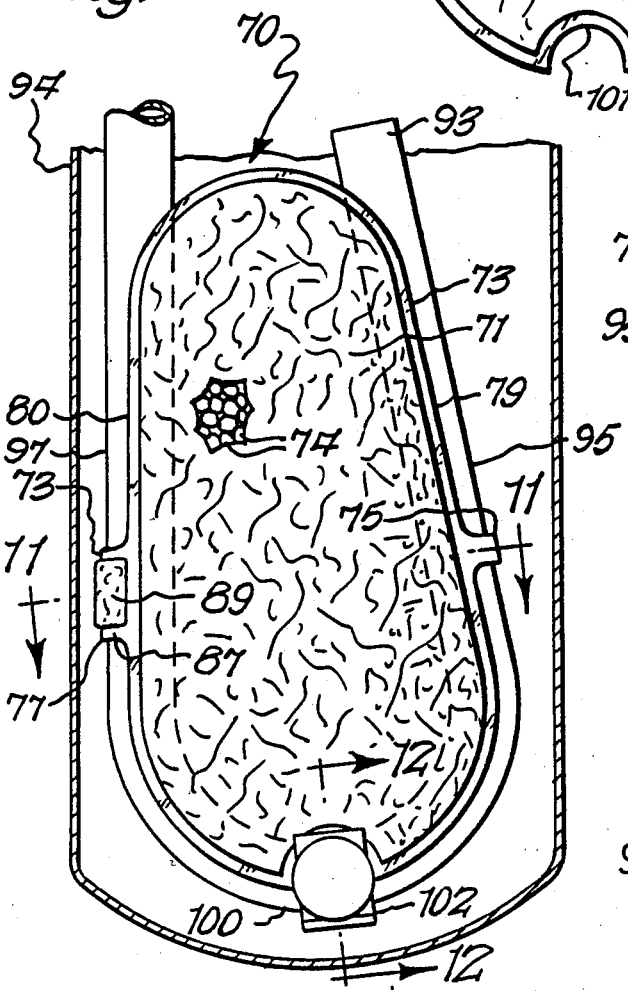
Fig. 10.
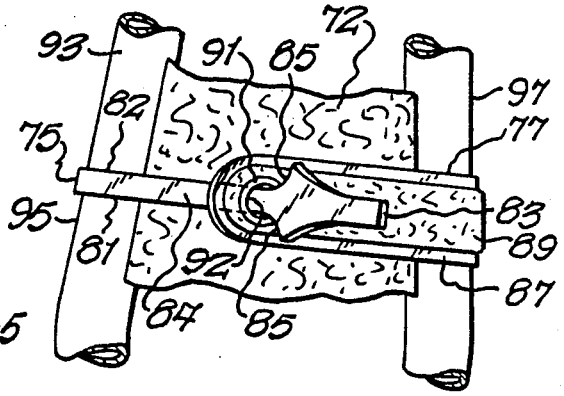
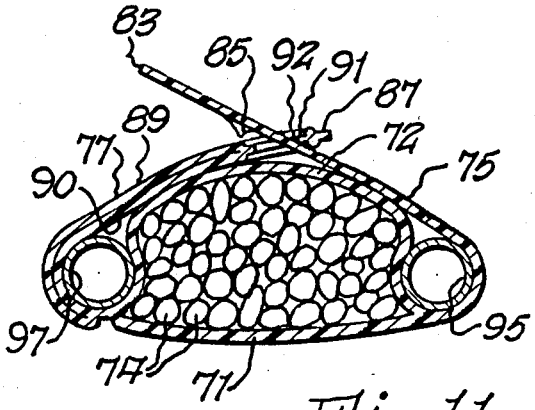
Fig. 11.

SELF-RETAINING ADSORBENT CARTRIDGE FOR REFRIGERANT RECEIVER

BACKGROUND OF THE INVENTION

The present invention relates to an improved adsorbent cartridge for a refrigerant receiver, the improvement residing in the self-retaining feature thereof when it is mounted on a conduit within the receiver.

By way of background, there are in common usage adsorbent cartridges which have spaced adsorbent containers connected by a central portion which underlies a return bend of an U-shaped conduit of a refrigerant receiver, with the spaced containers lying on opposite sides of the U-shaped conduit. In the past, one way of mounting the adsorbent cartridge on the U-shaped conduit was to orient it in the above-described position manually and thereafter wind a wire around the adsorbent containers located in side-by-side relationship on opposite sides of the U-shaped conduit. However, this required the cost of the wire and the cost of the labor for winding the wire around the adsorbent cartridge. The same deficiency was existent in adsorbent cartridges which comprised only a single container.

SUMMARY OF THE INVENTION

It is accordingly one important object of the present invention is to provide an unique latching structure associated with the opposite portions of an adsorbent cartridge for retaining it in assembled relationship with a U-shaped conduit of a refrigerant receiver.

Another object of the present invention to provide an improved desiccant cartridge having spaced adsorbent container portions which can be assembled onto an U-shaped conduit of a refrigerant receiver by virtue of structure which is an integral part of the adsorbent cartridge. Other objects and attendant advantages of the present invention will readily be perceived hereafter.

The present invention relates to a self-retaining adsorbent cartridge comprising an elongated casing, adsorbent in said casing, opposite portions on said casing, and means on said opposite portions for securing said opposite portions to each other.

The present invention also relates to an improvement in a refrigerant receiver having a housing, and a U-shaped conduit therein with spaced conduit portions thereon, the improvement comprising a self-retaining adsorbent cartridge comprising a casing, adsorbent in said casing, edge portions on said casing, and tab means at said edge portions for securing said casing relative to said U-shaped conduit.

The various aspects of the present invention will be more fully understood when the following portions of the specification are read in conjunction with the accompanying drawings wherein:

BRIEF DESCRIPTION OF THE DRAWINGS

FIG. 8 is a fragmentary side elevational view of another embodiment of the present invention;

FIG. 9 is a fragmentary side elevational view, partially in cross section, of the embodiment of FIG. 8 mounted on a conduit of a refrigerant receiver;

FIG. 10 is a fragmentary side elevational view of the rear side of FIG. 9;

FIG. 11 is a cross sectional view taken substantially along line 11—11 of FIG. 9; and FIG. 12 is a fragmentary cross sectional view taken substantially along line 12—12 of FIG. 9.

DESCRIPTION OF THE PREFERRED EMBODIMENTS

Figures 1, 2, 3, 4:
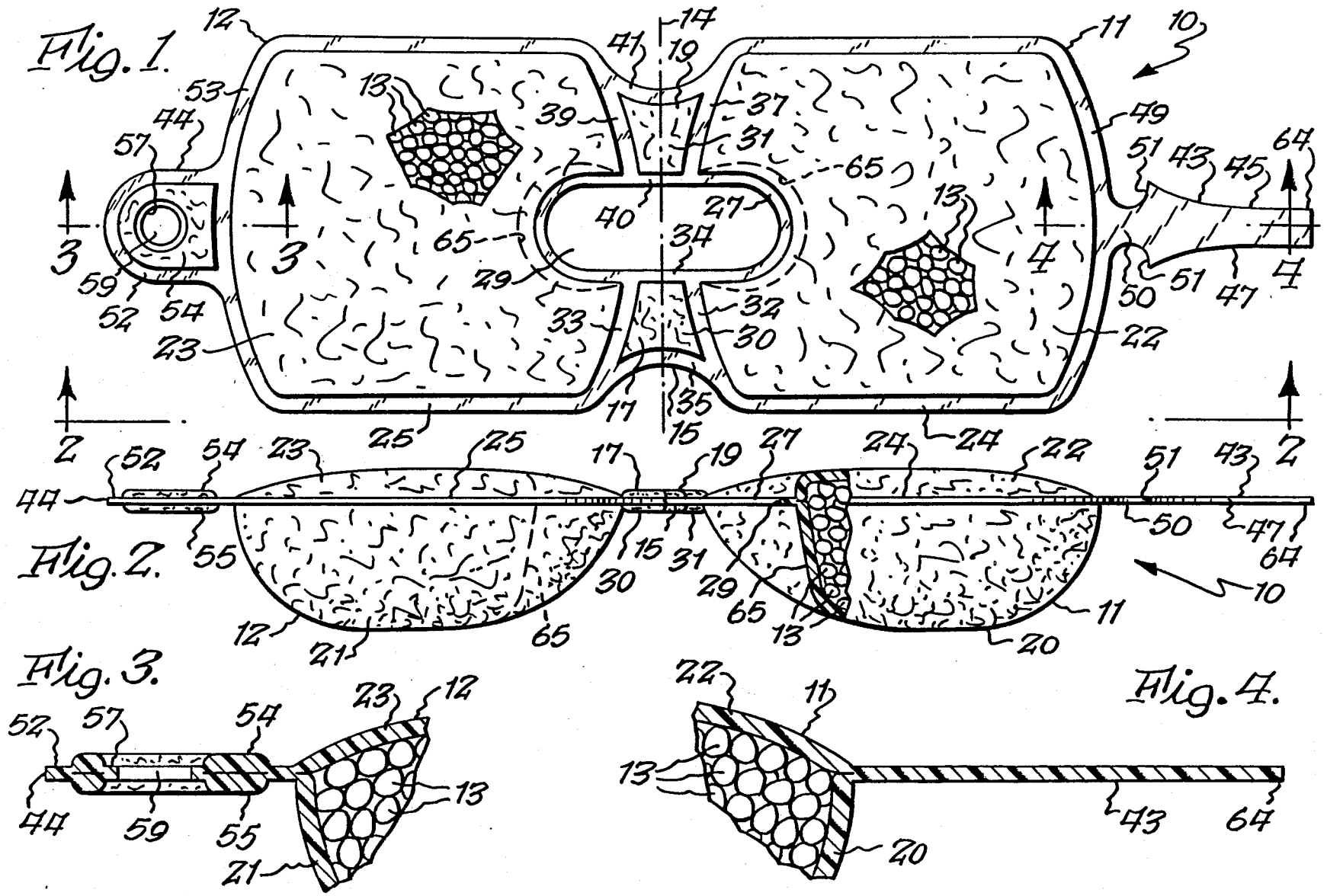
FIG. 1 is a plan view, partially broken away, of the improved adsorbent cartridge of the present invention.
FIG. 2 is a side elevational view, partially broken away, taken substantially in the direction of arrows 2—2 of FIG. 1.
FIG. 3 is an enlarged fragmentary cross sectional view taken substantially along line 3—3 of FIG. 1 and showing one portion of the latch structure.
FIG. 4 is an enlarged fragmentary cross sectional view taken substantially along line 4—4 of FIG. 1 and showing the other portion of the latching structure.

One embodiment of the self-retaining adsorbent cartridge 10 of the present invention, as shown in FIGS. 1-7, includes a casing consisting of two spaced containers 11 and 12 each containing a suitable adsorbent 13 which may selectively include, without limitation, silica gel, metal alumina silicate, calcium sulphate, activated charcoal, molecular sieve, or any other desired compound in bead, granular or pellet form.

Containers 11 and 12 are essentially mirror images of each other about centerline 14, except for the latching structure on their outer ends, and they are connected to each other by a yoke structure 15 consisting of two yoke halves 17 and 19. The cartridge 10 is fabricated out of two pieces of porous polyester felt material which are suitably joined to each other. In this respect, containers 11 and 12 include one piece of porous polyester felt which is formed into cup-shaped portions 20 and 21, respectively. The opposite sides of containers 11 and 12 are formed from one piece of porous polyester felt which are formed into sides 22 and 23 which are secured to sides 20 and 21, respectively, at fused peripheral edge portions 24 and 25, respectively, which extend completely around each of the containers 11 and 12, respectively.

The fusion of edge portions 24 and 25 may be effected by any process which applies sufficient heat and pressure to join the opposite sheets to each other. The polyester sheets are also fused to each other along border 27 which surrounds opening 29. Yoke portions 17 and 19 have central portions 30 and 31, respectively, which consist of two layers of felt which are not fused to each other. Portion 30 is bounded by fused border portions 32 and 33 of fused borders 24 and 25, respectively, portion 34 of fused border 27 and fused border 35. Unfused yoke portion 31 is bounded by fused portions 37 and 39 of fused borders 24 and 25, respectively, fused portion 40 of fused border 27 and fused portion 41. The major portions 20, 21, 22 and 23 of containers 11 and 12 are pliable, flexible felt, as are yoke portions 30 and 31.

However, the fused border portions discussed above are stiffer, less pliable, and more brittle. However, they are not so brittle that they cannot be flexed so as to permit the adsorbent cartridge 10 to assume the positions of FIGS. 5 and 6 from the straight positions of FIGS. 1 and 2. However, the pliability of the original felt is retained in yoke portions 30 and 31 to enhance the flexibility of the yoke.

In accordance with the present invention, a latch structure 42 (FIG. 5) is formed by latch portions 43 and 44 which are essentially tabs formed integrally at the outer ends of containers 11 and 12, respectively. More specifically, latch member 43 is essentially an elongated barb-like member having edges 45 and 47 which flare outwardly as they approach portion 49 of fused border 24 and which has a reduced neck 50 so as to provide shoulders 51 on latch member 43. Latch member 43 is stiffer than the felt from which it was fused, and it is of the same stiffness as all of the other borders, such as 24 and 25, which were fused by suitable heat and pressure. While latch member 43 is relatively stiff, it is flexible and resilient and it can be flexed relative to container 11 about neck 50. Latch member 43 is thinner than the two layers of felt from which it was formed.

Latch member 44 is essentially a tab having a fused border 52 which extends outwardly from portion 53 of fused border 25. Unfused portions 54 and 55 of the two sheets of material which are superimposed on each other to form the various containers are surrounded by the fused portion 52 and the fused portion of border 25. A fused circular portion 57 surrounds aperture 59. Fused borders 52 and 57 stiffen tab 44, but it can still be flexed relative to the remainder of the container 12 from which it extends.

Figure 5:
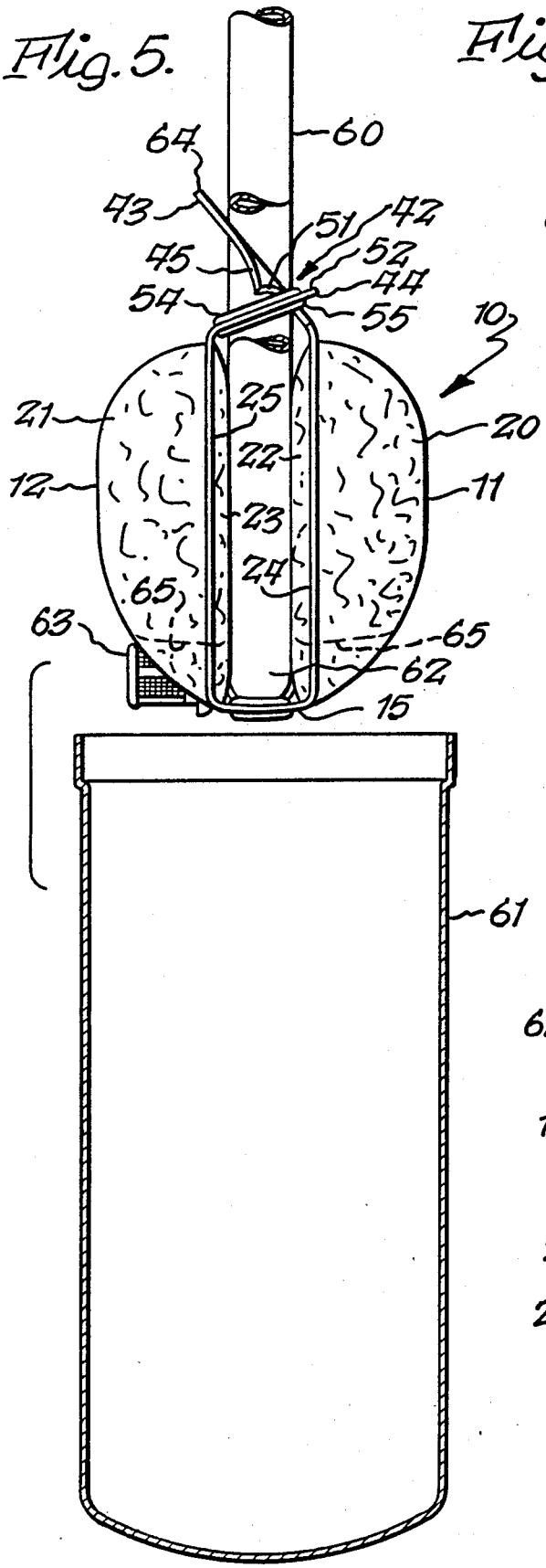
FIG. 5 is a fragmentary exploded view showing the improved self-retaining cartridge of FIG. 1 mounted on the U-shaped conduit which is to be inserted into the housing of a refrigerant receiver.
Figure 7:
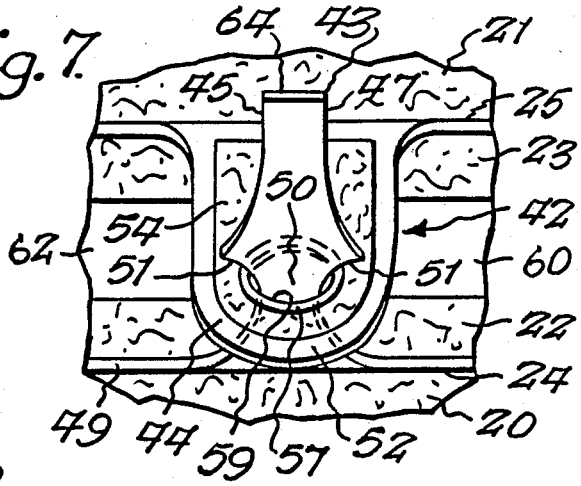
FIG. 7 is an enlarged fragmentary view taken substantially in the direction of arrows 7—7 of FIG. 6 and showing the latching structure of the adsorbent cartridge locking the two ends thereof together.
Figure 6:
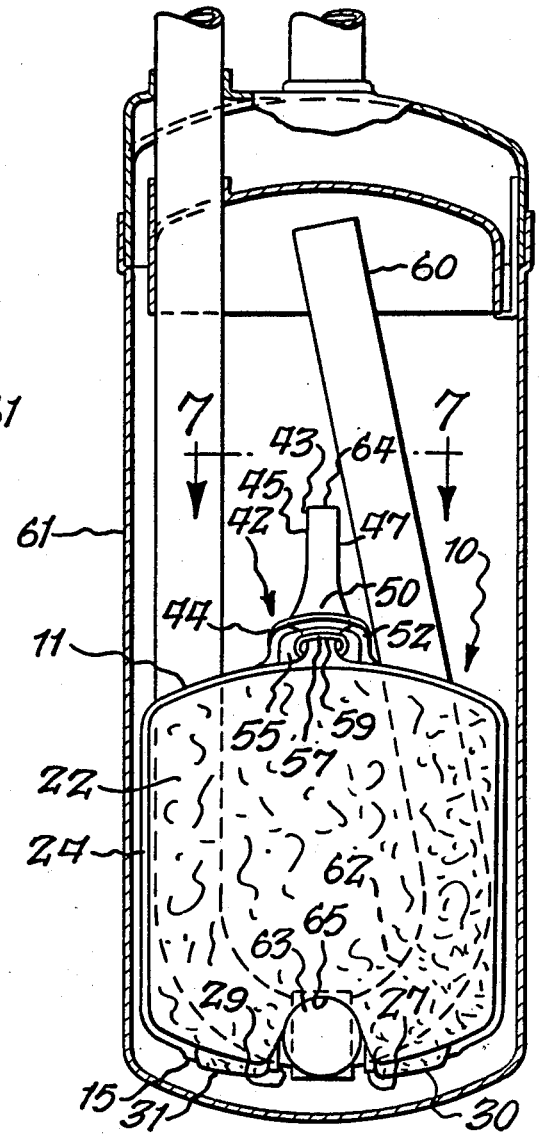
FIG. 6 is a fragmentary cross sectional view showing the U-shaped conduit with the self-retaining adsorbent cartridge thereon mounted in position within a refrigerant receiver.

As explained briefly above, in the past adsorbent cartridges similar to cartridge 10 were held in position on an U-shaped refrigerant receiver cartridge 60 by a wire which was wound around the outsides of the two adsorbent containers which were positioned in the manner such as shown in FIGS. 5 and 6. The drawback of this particular construction was that the wires not only did cost money, but, in addition, labor was required to position and hold the spaced containers in the attitude shown in FIG. 5 and thereafter wind the wire around them to retain them in position prior to the time that the assembled U-shaped conduit 60 was slid into its receiver housing 61. The construction of the present invention eliminates the foregoing labor and cost of material.

In accordance with the present invention shown in FIGS. 1–7 in order to mount adsorbent cartridge 10 onto U-shaped conduit 60, it is merely necessary to locate yoke 15 proximate return bend 62 and in underlying relationship therewith, with opening 29 associated with yoke 15 receiving filter 63 which is mounted on return bend 62 in the conventional manner. It will be appreciated that since opening 29 is symmetrical about centerline 14, adsorbent cartridge 10 can be mounted on U-shaped conduit 60 with containers 11 and 12 in the orientation shown in FIG. 5 or in a reverse orientation. Once the adsorbent cartridge has been oriented in the attitude shown in FIG. 5, it is merely required to insert the tip 64 of latch portion 43 through aperture 59 of latch portion 44 and thereafter pull it through. The edge portions 45 and 47 of latch member 43 will ride along border 57 of aperture 59 and because of the flexibility of latch portion 43, the outer edge portions leading to shoulders 51 will curl or flex and pass through aperture 59, and thereafter, because of the resiliency of portion 43, it will expand to the condition shown in FIGS. 5 and 7 whereupon shoulders 51 will lock against border 57 of aperture 59 to thereby retain the cartridge 10 in the position shown in FIG. 5 with the surfaces of container portions 22 and 23 facing each other and lying against the legs of U-shaped conduit 60. Furthermore, the sides of one of the concave depressions 65 of members 21 or 20 (FIG. 2) will overlie filter 63 (FIG. 6) to prevent cartridge 10 from slipping down away from return bend 62 or sideways relative thereto prior to the time that it is inserted into housing 61.

In FIGS. 8–12 another embodiment of a self-retaining adsorbent cartridge is shown. Cartridge 70 includes a casing having opposite sides 71 and 72 which are fused to each other along the entire circumferential peripheral edge 73. Sides 71 and 72 are fabricated of the same material described above relative to the preceding figures and edge 73 is formed in the same manner. The sides 71 and 72 confine adsorbent material 74 therein which may be identical to material 13 of FIGS. 1–7.

In accordance with the present invention, locking tabs 75 and 77 extend outwardly from cartridge side edges 79 and 80, respectively. Locking tab or latch member 75 is formed in the same manner as latch member 43 by fusing extensions of sides 71 and 72 to each other. The configuration of latch member 75 is essentially the same as that of latch member 43 described above. It is an elongated barb-like member which has edges 81 and 82 which flare outwardly as they approach border 79 from outer end 83 and which has a reduced neck 84 so as to provide shoulders 85 on latch member 75. Latch member or locking tab 77 is analogous to latch member 44 of the embodiment of FIGS. 1–7 and it is essentially a tab having a fused border 87 which extends outwardly from fused border 80. Unfused portions 89 and 90 of sides 71 and 72, respectively, remain unfused within border 87. A fused circular portion 91 surrounds aperture 92 which receives the end portion of latch member 75 and retains it therein in the manner shown in FIG. 10. Latch members or locking tabs 75 and 77 have all of the physical characteristics described above relative to latch members 43 and 44 and they function in the same manner.

As described above relative to latch portions 43 and 44, latch portions 75 and 77 are flexible, notwithstanding that the fused portions thereof are stiffer than the sides 71 and 72 from which they were formed. This flexibility permits the end of latch portion 75 to be bent and to be threaded through aperture 92, and, once threaded therethrough, the stiffness of shoulders 85 will retain it in position. Also latch member 77 can be bent to the condition of FIGS. 9 and 11.

In use, the cartridge 70 is mounted on a return bend conduit 93 of a refrigerant receiver 94 as shown in FIGS. 9–12 with side 72 inserted between conduit portions 95 and 97 and with side 71 overlying these conduit portions (FIG. 11). Thereafter, latch members 75 and 77 are positioned in encircling engagement with conduit portions 95 and 97 and the end of latch portion 75 is threaded through aperture 92. An extension 99 (FIG. 12) of side 72 rests within the lowermost portion 100 of return bend 93 and the recess 101 at the bottom of cartridge 70 receives filter portion 102.

It can thus be seen that the embodiment of FIGS. 8–12 functions in substantially the same manner as the embodiment of FIGS. 1–7 in the sense that it possesses a self-retaining latch structure integrally formed therewith for mounting the cartridge on an associated conduit in a refrigerant receiver.

It will be appreciated that variations of the above described embodiments are within the scope of the present invention. While the tab portions are shown as having been formed integrally with each of the adsorbent containers, it will be appreciated that the can be attached thereto as separate tab members, as by sewing or by other forms of attachment, especially if the containers, such as 11 and 12 of FIGS. 1–7, or the cartridge of FIGS. 8–12, are formed with stitched borders rather than fused borders. Furthermore, while the fastening members at the outer ends of containers 11 and 12 of FIGS. 1–7 or at the outer edges of sides 79 and 80 of the embodiment of FIGS. 8–12, have been depicted as latch members which lock relative to each other, it will be appreciated that it is within the scope of the present invention that the latch members may be in the form of tabs which do not interfit with each other but which are fastened to each other in any suitable manner as with a staple or a clip or in any other way, the primary consideration being that means are provided which can be secured to each other to retain the adsorbent cartridges 10 or 70 in positions such as shown in FIG. 5 or FIG. 9 for insertion into an associated refrigerant receiver housing. It further will be appreciated that while the above-described preferred embodiment of FIGS. 1-7 discloses two containers connected by a yoke which does not contain adsorbent, the retaining structure of the present invention can be used with an elongated adsorbent cartridge which assumes the position of FIGS. 1–7 but does not have a yoke structure for enhancing flexibility of its central portion. Also, it will be appreciated that while the latch members of the embodiment of FIGS. 1–7 are located at the extreme ends of the containers with which they are associated, they can be suitably attached to portions of the containers which are remote from the extreme end portions, as clearly shown in the embodiment of FIGS. 8–12.

While preferred embodiments of the present invention have been disclosed, it will be appreciated that the present invention is not limited thereto but may be otherwise embodied within the scope of the following claims.

What is claimed is:

1. A self-retaining adsorbent cartridge comprising an elongated adsorbent cartridge having opposite end portions and a central portion therebetween, cartridge portions proximate said opposite end portions and on opposite sides of said central portion, adsorbent in said cartridge, and means on said opposite end portions for securing said opposite end portions to each other to cause said cartridge portions proximate said opposite end portions to lie in side-by-side relationship with a bend in said central portion.

2. A self-retaining adsorbent cartridge as set forth in claim 1 wherein said cartridge portions comprise first and second adsorbent containers, and means at said central portion for securing said first and second containers to each other.

3. A self-retaining adsorbent cartridge as set forth in claim 2 wherein said last-mentioned means comprise a yoke.

4. A self-retaining adsorbent cartridge as set forth in claim 1 wherein said last-mentioned means comprise tab means on said opposite end portions.

5. A self-retaining adsorbent cartridge as set forth in claim 4 wherein said tab means comprise latch means.

6. A self-retaining adsorbent cartridge as set forth in claim 5 wherein said latch means comprise a first member at one of said opposite ends, an aperture in said first member, and a second member at the other of said opposite ends for reception in said aperture.

7. A self-retaining adsorbent cartridge as set forth in claim 6 wherein said second member is flexible and includes portions of greater dimension than said aperture so that said greater dimension prevents it from being removed from said aperture after it has been received therein.

8. A self-retaining adsorbent cartridge as set forth in claim 4 wherein said adsorbent cartridge includes a fabric casing and wherein said tab means comprise extensions of said fabric casings.

9. A self-retaining adsorbent cartridge as set forth in claim 8 wherein said fabric casing is relatively soft and pliable, and wherein said tab means comprise a tab on each of said opposite end portions, and wherein at least one of said tabs is stiffened.

10. A self-retaining adsorbent cartridge as set forth in claim 9 wherein said fabric casings are fabricated from plastic material, and wherein said at least one of said tabs is stiffened by said plastic material being compressed and fused.

11. A self-retaining adsorbent cartridge as set forth in claim 10 wherein one of said tabs includes an aperture therein, and wherein the other of said tabs comprises an elongated member for reception in said aperture.

12. A self-retaining adsorbent cartridge as set forth in claim 11 wherein said elongated member is flexible and includes portions of greater dimension than said aperture so that said greater dimension prevents it from being removed from said aperture after it has been received therein.

13. In a refrigerant receiver having a housing and an U-shaped conduit therein and a return bend on said conduit: a self-retaining adsorbent cartridge comprising a casing, adsorbent in said casing, a surface on said casing, a central portion on said casing, opposite end portions on said casing, and means proximate said opposite end portions for securing said cartridge in relationship to said U-shaped conduit with said central portion on the outside of said return bend and with spaced portions of said surface oriented in facing relationship.

14. In a refrigerant receiver as set forth in claim 13 wherein said last-mentioned means comprise first and second tab means.

15. In a refrigerant receiver as set forth in claim 14 wherein said first and second tab means comprise latch means.

16. In a refrigerant receiver as set forth in claim 15 wherein said latch means comprise first means proximate one of said ends, and second means proximate the other of said ends for interfitting with said first means.

17. In a refrigerant receiver as set forth in claim 16 wherein said first tab means includes an aperture therein, and wherein said second tab means comprises an elongated member for reception in said aperture.

18. In a refrigerant receiver as set forth in claim 17 wherein said elongated member is flexible and includes portions of greater dimension than said aperture so that said greater dimension prevents it from being removed from said aperture after it has been received therein.

19. In a refrigerant receiver as set forth in claim 14 wherein said casing is a fabric, and wherein said first and second tab means are extensions of said fabric.

20. In a refrigerant receiver as set forth in claim 19 wherein said fabric is relatively soft and pliable, and wherein at least one of said tab means is stiffened.

21. In a refrigerant receiver as set forth in claim 20 wherein said fabric is plastic material, and wherein said at least one of said tab means is stiffened by said plastic material being compressed and fused.

22. A self-retaining adsorbent cartridge comprising a casing, adsorbent in said casing, opposite edge portions on said casing, and means on said opposite edge portions for securing said opposite edge portions relative to each other.

23. A self-retaining adsorbent cartridge as set forth in claim 22 wherein said casing comprises a single casing, and wherein said last-mentioned means comprise elongated tabs extending outwardly from said opposite edge portions.

24. A self-retaining adsorbent cartridge as set forth in claim 22 wherein said elongated casing comprises a pair of spaced containers each containing said adsorbent, and wherein said last-mentioned means comprise tabs extending outwardly from said opposite edge portions.

25. A self-retaining adsorbent cartridge as set forth in claim 24 wherein said opposite edge portions comprise side edge portions and end edge portions, and wherein said tabs extend outwardly from said end edge portions.

26. In a refrigerant receiver having a housing and a U-shaped conduit therein with spaced conduit portions thereon: a self-retaining adsorbent cartridge comprising a casing, adsorbent in said casing, edge portions on said casing, and tab means at said edge portions for securing said casing relative to said U-shaped conduit.

27. In a refrigerant receiver as set forth in claim 26 wherein said casing includes side edge portions, and wherein said tab means secure said side edge portions to each other and encircle said spaced conduit portions.

28. In a refrigerant receiver as set forth in claim 26 wherein said casing includes end edge portions, and wherein said tab means extend between said spaced conduit portions and secure said end edge portions to each other.

* * * * *